US008015674B2

(12) United States Patent
Matsui et al.

(10) Patent No.: US 8,015,674 B2
(45) Date of Patent: Sep. 13, 2011

(54) SLIDE FASTENER ENGAGING ELEMENT AND SLIDE FASTENER

(75) Inventors: Shoji Matsui, Toyama-Ken (JP); Teruo Ozaki, Toyama-Ken (JP); Katsuo Satake, Toyama-Ken (JP)

(73) Assignee: YKK Corporation (JP)

( * ) Notice: Subject to any disclaimer, the term of this patent is extended or adjusted under 35 U.S.C. 154(b) by 870 days.

(21) Appl. No.: 12/037,169

(22) Filed: Feb. 26, 2008

(65) Prior Publication Data

US 2008/0209695 A1 Sep. 4, 2008

(30) Foreign Application Priority Data

Mar. 2, 2007 (JP) ..... 2007-053176

(51) Int. Cl.
*A44B 19/02* (2006.01)
*A44B 19/04* (2006.01)
*A44B 19/24* (2006.01)

(52) U.S. Cl. ..... 24/413; 24/409; 24/411

(58) Field of Classification Search ..... 24/403, 24/405, 409–413

See application file for complete search history.

(56) References Cited

U.S. PATENT DOCUMENTS

| | | | | | |
|---|---|---|---|---|---|
| 1,615,113 | A | | 1/1927 | Draher et al. | |
| 1,659,480 | A | | 2/1928 | Carpmill | |
| 1,680,266 | A | * | 8/1928 | Galat | 24/406 |
| 1,837,011 | A | * | 12/1931 | Blair | 24/411 |
| 1,837,511 | A | * | 12/1931 | Whitney | 24/409 |
| 4,004,327 | A | * | 1/1977 | Fukuroi et al. | 24/411 |
| 4,635,324 | A | * | 1/1987 | Hoerkens | 24/413 |

FOREIGN PATENT DOCUMENTS

DE 462647 7/1928

* cited by examiner

*Primary Examiner* — Robert Sandy

(74) *Attorney, Agent, or Firm* — Kilpatrick Townsend & Stockton LLP

(57) ABSTRACT

A metallic engaging element of vintage type having a pair of leg portions formed so as to branch to right and left sections from the bottom of a body portion of the engaging element. The leg portions are formed into an L-like sectional shape including a sheet-like nipping portion and a leg portion side wall. The sheet-like nipping portion has a notch portion for sandwiching one side edge portion of a fastener tape from the front and rear surfaces. At least one projecting portion is formed in each of leg portion inner wall surfaces opposing the one side edge portion of the fastener tape in the leg portion side wall.

6 Claims, 5 Drawing Sheets

SLIDE FASTENER ENGAGING ELEMENT AND SLIDE FASTENER

INCORPORATION BY REFERENCE

The present application claims priority under 35 U.S.C. §119 to Japanese Patent Application No. 2007-053176 filed on Mar. 2, 2007. The content of the application is incorporated herein by reference in its entirety.

BACKGROUND OF THE INVENTION

1. Field of the Invention

The present invention relates to the structure of a metallic engaging element that is attached to a side edge portion of a fastener tape of a slide fastener and a slide fastener including the engaging elements.

2. Description of the Invention

In some type of slide fastener for use in opening/closing, for example, clothes and bags, engaging elements made of a synthetic resin obtained by injection molding or engaging elements continuous in a coil or zigzag shape made of a synthetic resin are formed integrally to a fastener tape by molding or sewing. On the other hand, various kinds of slide fasteners have been provided that include metallic engaging elements in order to express a feature from design viewpoint, texture and massiveness. Known materials available for the metallic engaging elements include rolled materials of nickel silver, brass, aluminum or the like and cast materials.

As slide fasteners using metal as a material of engaging elements, there are old type fasteners about 100 years old which employ 100% cotton yarns as its fastener tape and use pressed components made of nickel silver for, for example, the engaging elements and bottom end stop, and products which satisfy military standard. Some of these old type slide fasteners are called vintage type slide fastener, and attract public attention among mania as a consumer use purpose also from the reason of historical values and appearance. Thus, such slide fasteners have been dealt with vividly today also.

The military standard slide fastener not only assures the usage condition and environmental condition but also requires process control and quality control for guaranteeing the specification more precisely than the consumer use products in terms of the quality of a raw material and manufacturing process. As a result, the product price of the slide fastener is boosted largely so that it cannot meet demands for consumer use purposes in which the design aspect is regarded as the most important factor.

As this kind of the slide fastener having the conventional metallic engaging elements, for example, U.S. Pat. No. 1,615,113 (patent document 1), U.S. Pat. No. 1,659,480 (patent document 2) and German Patent No. 462647 (patent document 3) have been known. In these slide fasteners, a sheet metal is punched out to obtain small pieces, and the resulting pieces are formed by pressing and attached in line at predetermined intervals by press-fitting on the side edge portion of the fastener tape so as to arrange metallic engaging elements.

The slide fastener engaging element described in the patent document 1 is comprised of: a head portion having a coupling opening for coupling the engaging elements attached to stringers opposing with each other or an coupling pawl; a pair of right and left leg portions for attachment to one side edge of a fastener tape; and a body portion for connecting the leg portions with the head portion. The slide fastener engaging element described in the patent document 3 is comprised of: a head portion having a coupling neck portion and a coupling concave portion to be coupled with an engaging element attached to a mating side stringer; a pair of right and left leg portions for attachment to one side edge portion of a fastener tape; and a body portion for connecting the leg portion with the head portion.

The leg portions of the engaging elements described in the patent documents 1 and 3 each are formed symmetrically so as to branch to right and left sections from the body portion. The pair of right and left leg portions each is constituted of a sheet-like nipping portion having two notch portions for sandwiching the front and rear surfaces of the side edge portion of the fastener tape and a leg portion side wall erected from the sheet-like nipping portion. The section of the leg portion is substantially L shaped. Leg portion outside wall surfaces of the leg portion side wall parallel to the side edge of the fastener tape serve as a sliding surface which makes contact with the inside surface of right and left flanges of the slider in the slide fastener, thereby forming a substantially flat surface.

The slide fastener engaging element described in the patent document 2 is comprised of: a head portion for coupling the engaging elements attached to a mating stringer; a pair of right and left leg portions for sandwiching a side edge portion of a fastener tape from the front and rear surfaces thereof; and a body portion for connecting the leg portion with the head portion. The sheet-like nipping portions of the pair of right and left leg portions each have two cut-out portions for nipping two columns of core threads formed on the side edge of the fastener tape. However, no leg portion side wall is formed on the sheet-like nipping portion, and thus, the leg portion is flat, not formed into the L shape in its section.

Generally, the material of the slide fastener engaging elements described in the patent documents 2 and 3 is formed of a rolled sheet material made of alloy called nickel silver, that is produced by adding zinc and nickel to copper which is a base material. Using nickel silver as the material of the engaging element makes it easy to satisfy the standard about environment resistance, durability, lateral pulling force and upward pushing force, etc. due to the physical property of the nickel silver.

However, the nickel silver is an expensive material because it is alloy containing nickel. In addition, when the nickel silver is processed, a die or press die having a high hardness need to be used for processing because the tensile yield point of the material is high, thereby increasing the product price of the slide fastener. Thus, employing the nickel silver as the material of the engaging element causes such an inconvenience that use of the vintage type slide fastener is difficult to expand in public for consumer use purpose.

In some cases, the engaging element of the vintage type slide fastener made of nickel silver may be replaced with a material having a low yield point such as brass while its shape is kept unchanged in order to reduce the price of the slide fastener. In such cases, the pair of leg portions for sandwiching the fastener tape becomes likely to be opened, so that there is a possibility that the fixing strength of the engaging element to the fastener tape is dropped.

When the lateral pulling force or the upward pushing force is applied to the slide fastener in engagement, the weakened fixing strength of the engaging element poses the following disadvantages. That is, the engaging elements are inclined to be opened, the engaging elements tilt with respect to the fastener tape, the engaging element deviates from the fastener tape, or the engaging element slips out of the fastener tape.

SUMMARY OF THE INVENTION

The present invention has been achieved to solve the above-described problems, and an object of the invention is to provide a vintage type slide fastener at low cost, which is conventionally expensive as well as provide a metallic engaging element having an intensified fixing force to the fastener tape.

To achieve the above-described object, the present invention provides a slide fastener engaging element made of metal in which a head portion, a body portion and a pair of leg portions are integrally formed, the leg portions being branched from the body portion to the right and left sections to be attached to one side edge portion of a fastener tape so that the one side edge portion is sandwiched thereby. Each of the pair of leg portions is formed into a L-like section shape having a sheet-like nipping portion and a leg portion side wall that rises at right angle from right or left outside side edge of the sheet-like nipping portion. The sheet-like nipping portion has notch portions for sandwiching the one side edge portion of the fastener tape from front and rear surfaces. At least one projecting portion is formed on a leg portion inner wall surface of the leg portion side wall opposing the one side edge portion of the fastener tape.

According to a preferred aspect, a leg portion outer wall surface the leg portion side wall opposite to the surface from which the projecting portion is projected can be formed into a sliding surface which makes contact with an inside surface of a slider for the slide fastener. The projecting portion may be formed into a rib shape extending parallel to the side edge of the fastener tape. The projecting portion may be formed on each of the opposing portions of the pair of leg portion side walls. An outer wall concave portion may be formed in the leg portion outer wall surface opposite to the surface from which the projecting portion is projected.

The slide fastener engaging element of the present invention is provided with at least one projecting portion on the leg portion inner wall surface of the leg portion side wall. Therefore, different from the conventional patent document 3 describing that the core thread provided along the side edge of the fastener tape is sandwiched by the circular notch portions formed in the tape nipping portion of each of the right and left leg portions, the core thread is sandwiched by the circular notch portions and at the same time, the projecting portions press a portion expanding from the circular notch portion strongly to deform the portion, thereby exerting an effect as an anchor. Consequently, the fixing strength of the engaging element to the fastener tape is intensified so as to prevent the engaging element from deviating on the fastener tape or slipping out of the fastener tape.

Therefore, the fixing force of the engaging element to the fastener tape can be kept not lower than a predetermined value despite dispersion in the press-fitting force, the thickness of the fastener tape, the diameter of the core thread and the like. This improves resistance to the lateral pulling force and resistance to the upward pushing force. For example, even if a material having a low yield point such as brass is used instead of nickel silver as the material of the engaging element, the resistance to the lateral pulling force and resistance to the upward pushing force, which are equal to or higher than those of nickel silver, can be obtained.

Consequently, a highly ductile metallic material having a low yield point like brass rolled material can be used for the engaging element which is formed of nickel silver conventionally. It is possible to facilitate maintenance of consumable components such as a press die for use in forming the engaging element and a die of an implanting machine for use in attaching the engaging elements to the fastener tape and also to extend the service life of these consumable components. Thus, the slide fastener can be provided at low cost.

If the projecting portions formed on the leg portion inner wall surfaces each are formed into a rib shape extending in parallel to the side edge of the fastener tape, the engaging elements can press the fastener tape firmly in a wide range. This enables to prevent such faults as slippage of the engaging element on the fastener tape and inclination of the engaging element. When the projecting portions are formed on opposing portions of the pair of leg portion side walls, the core threads are sandwiched by the front and rear surfaces, so that the engaging elements can be fixed more securely and firmly to the side edge portion of the fastener tape.

Further, the outer wall concave portion is formed in the leg portion outer wall surface opposite to the surface from which the projecting portion is projected. With this configuration, the engaging element can be press-fit to the fastener tape while the engaging element is maintained in a stably positioned state by pressing an attachment tool against the outer wall concave portion, with the result that the engaging element can be attached to the fastener tape more securely. Further, provision of the outer wall concave portion can reduce a contact area with the inside surface of the slider to thereby improve sliding of the slider. Thus, operability of the slider is improved to facilitate the opening/closing operation of the slide fastener.

DESCRIPTION OF THE PREFERRED EMBODIMENTS

Hereinafter, a typical embodiment of an engaging element of the present invention and a slide fastener using the engaging element will be described with reference to the accompanying drawings.

Figure 1:
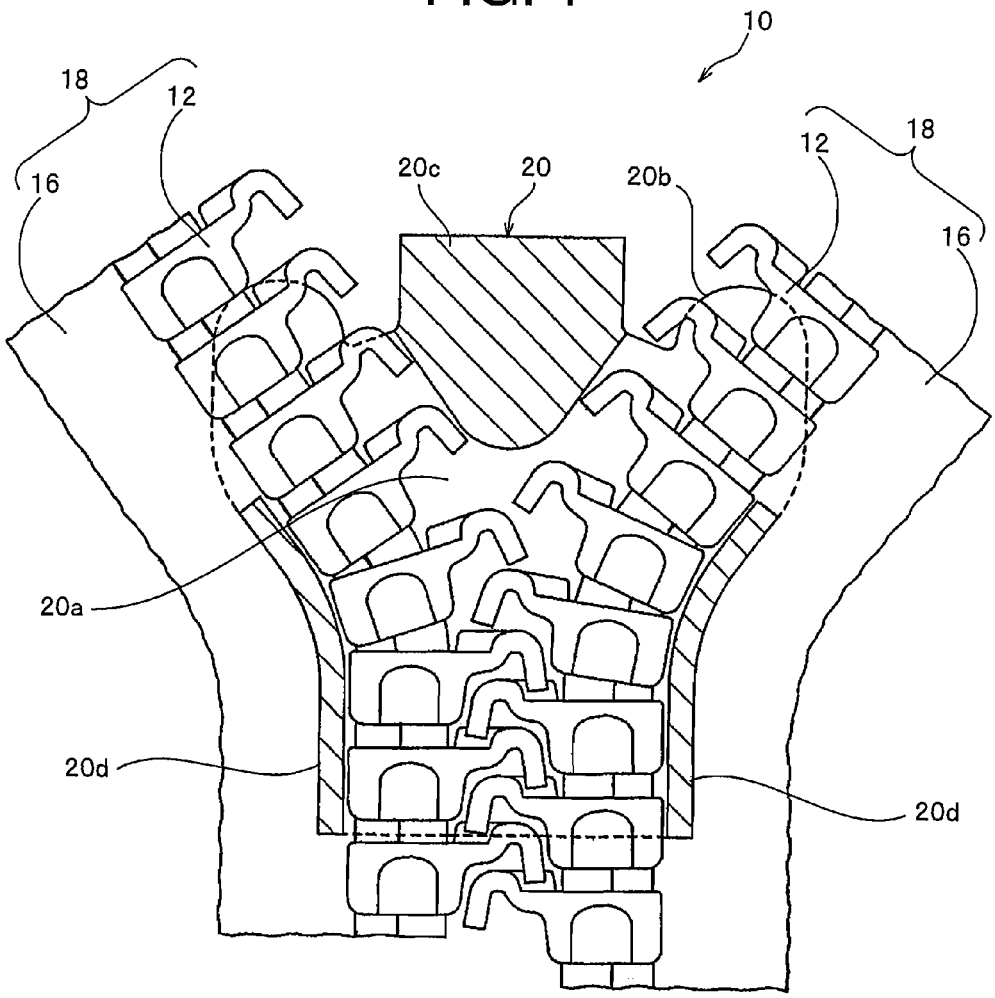
FIG. 1 is a plan view of a slide fastener in a state where a body of a slider is cut.
Figure 2:
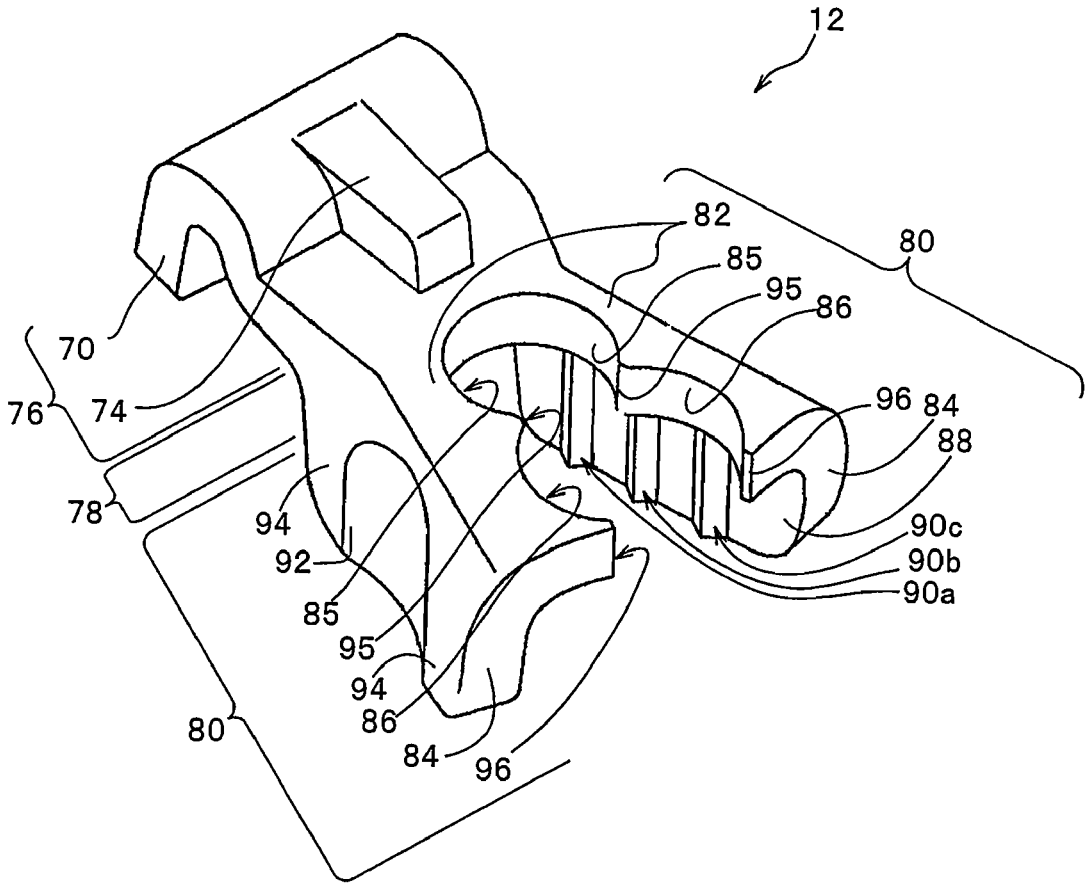
FIG. 2 is a perspective view of an engaging element according to one embodiment of the present invention as seen from the outside surface thereof.
Figure 3:
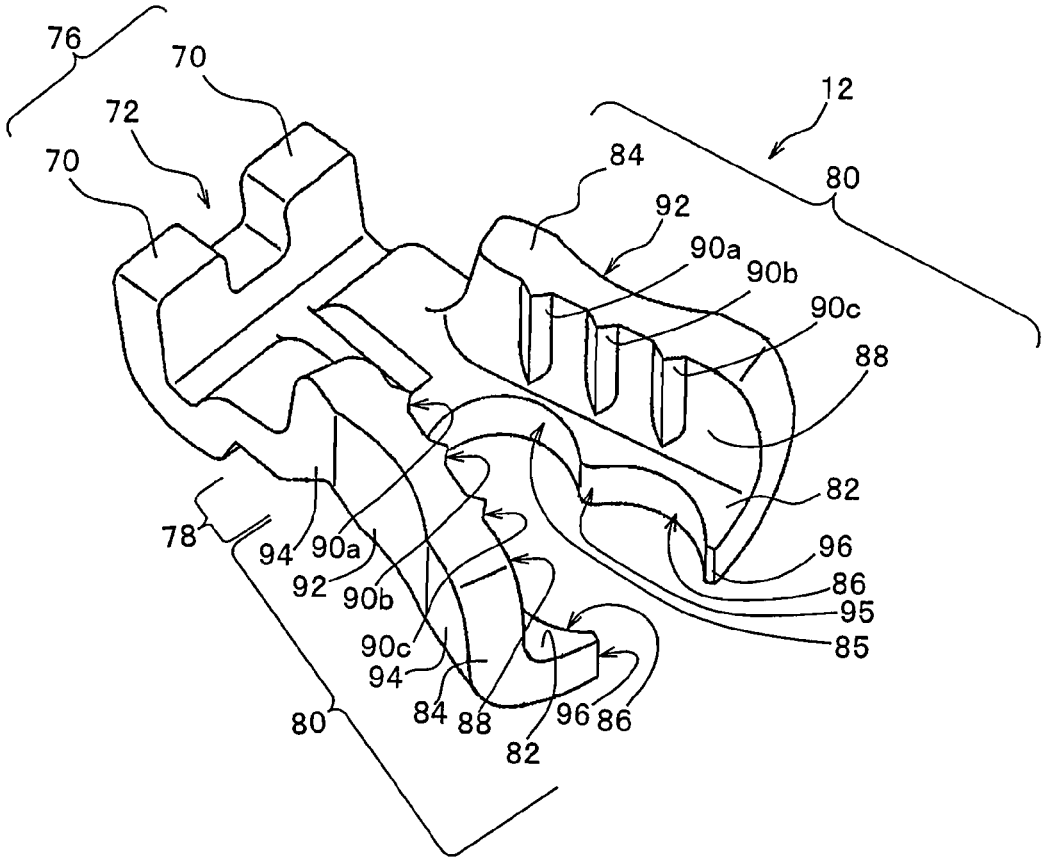
FIG. 3 is a perspective view of the engaging element according to the embodiment as seen from the inside surface thereof.
Figure 4:
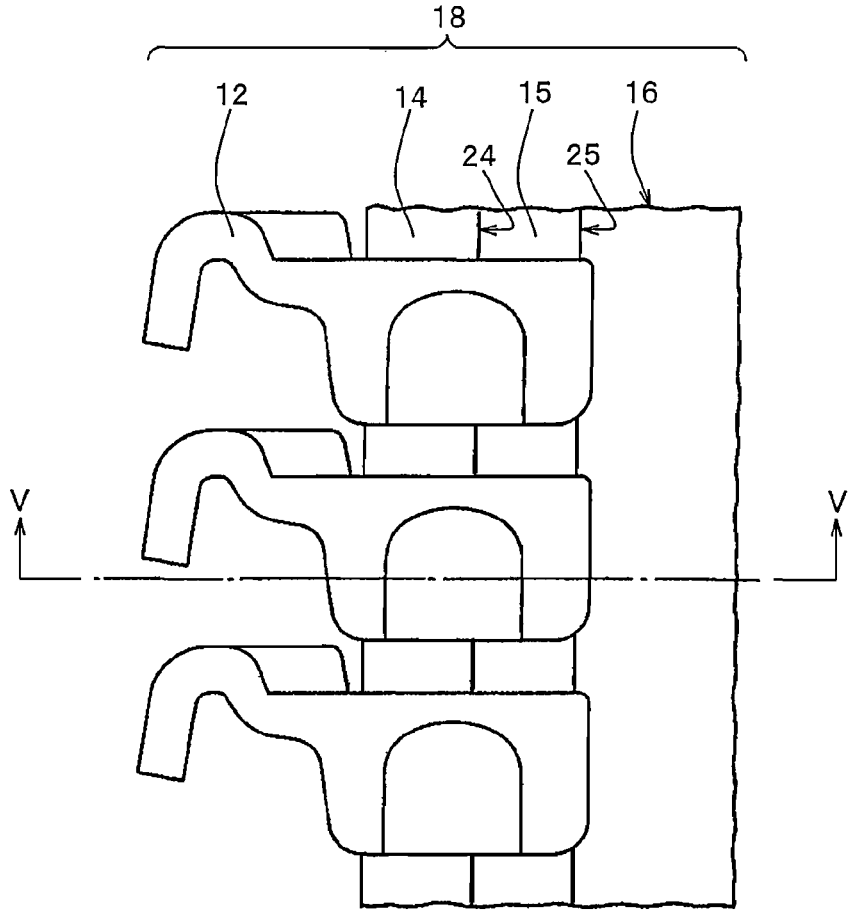
FIG. 4 is a plan view showing a state in which engaging elements are fixed in line on a side edge portion of a fastener tape.

FIG. 1 shows a state of the inside of a slider body when engaging elements 12 of a slide fastener 10 pass through a slider 20. FIGS. 2 and 3 are perspective views of the engaging element 12 of the present invention as seen from the front surface side and from the rear surface, respectively. The shape of the engaging element 12 shown in FIGS. 2 and 3 shows a state of a component with leg portions still open before the component is attached to a fastener tape 16. FIG. 4 is a plan view showing a state in which the engaging elements 12 are fixed in line on a side edge portion of the fastener tape 16.

Figure 5:
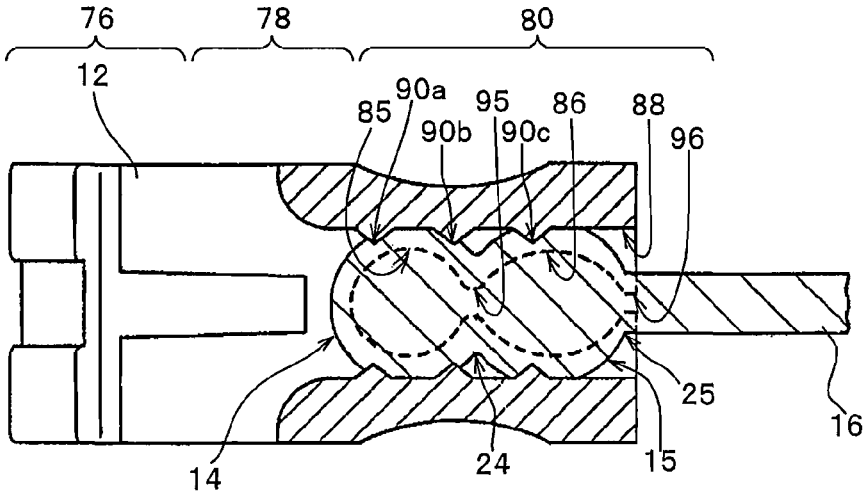
FIG. 5 is a sectional view taken along the line V-V in FIG. 4, showing an attachment state of the engaging element to the fastener tape.

FIG. 5 is a sectional view taken along the line V-V in FIG. 4, indicating an attachment state of the engaging element 12 to the fastener tape 16.

As shown in FIG. 1, the slide fastener 10 includes a pair of right and left fastener stringers 18 and a slider 20. The pair of fastener stringers 18 is formed by attaching metallic engaging elements 12 on a side edge portion of the fastener tape 16 in line at predetermined intervals. The slider 20 engages/disengages the pair of right and left engaging elements 12 with/from each other.

The slider 20 contains a guide passage 20*a* through which the engaging elements 12 of the right and left fastener stringers 18 pass internally. By sliding the slider 20 along an engaging element row, the opposing engaging elements 12 can be engaged or disengaged with/from each other. The guide passage 20*a* is formed into a Y shaped passage which is surrounded by: an upper plate (not shown) and a lower plate 20*b* disposed in a vertical direction; a connecting post 20*c* for connecting the upper plate with the front end portion of the lower plate 20*b*; and flanges 20*d* formed along right and left side edges of the upper plate and lower plate 20*b*, the flanges 20*d* projecting toward the opposing lower plate 20*b* or upper plate.

Next, the shape of the engaging element of the present invention will be described with reference to FIGS. 2 and 3. As shown in FIGS. 2 and 3, the engaging element 12 is constituted of a head portion 76, a body portion 78 and a pair of right and left leg portions 80.

The head portion 76 of the engaging element 12 is projected outwardly from the edge portion of the fastener tape 16. A pair of right and left coupling pawls 70, 70 are provided projectingly on one side surface in the longitudinal direction of the fastener tape 16. A coupling concave portion 72 is formed between the coupling pawls 70 and 70. An engaging projection 74 which is fitted in the engaging concave portion 72 is formed on the other side surface which is opposite to the one side surface.

The shape of the head portion of the engaging element shown in FIGS. 2 and 3 is substantially the same as the coupling head described in the patent document 2. However, the shape of the head portion of the engaging element of the present invention is not restricted to the head portion shape shown in FIGS. 2 and 3, but the shape of the head portion described in the patent document 1 or 3 or other head portion shapes may be adopted.

The leg portions 80 of the engaging element 12 are formed so as to branch to the right and left from the bottom of the body portion 78. The pair of right and left leg portions 80 is provided with sheet-like nipping portions 82, 82 to be attached to one side edge portion of the fastener tape 16 and leg portion side walls 84, 84 erected at right angle from the right and left outside side edges of the sheet-like nipping portions 82, 82. The pair of leg portions 80 is formed into L shaped sections symmetrical to each other.

The pair of sheet-like nipping portions 82, 82 has pairs of notch portions 85, 86 for nipping two rows of core threads formed on one side edge portion of the fastener tape 16 from the front and rear surfaces. These two notch portions 85, 86 are formed continuously in the longitudinal direction of the leg portion 80. An inner pawl 95 and an outer pawl 96 are formed at an intermediate portion between the notch portions 85 and 86 and at the front end of the leg portion of the notch portion 86 formed on a far side of the body portion. The pawls 95 and 96 are provided to press the fastener tape 16 with the respective core threads 14, 15 sandwiched. Here, the present invention has a feature in that at least one protruding portion 90*a*, 90*b*, 90*c* for sandwiching the core thread is formed on a leg portion inside wall surface 88 which makes contact with the side edge portion of the fastener tape 16.

A leg portion outer wall surface 94 of the leg portion side wall 84 functions as a sliding surface which makes contact with the inside surfaces of the upper plate and the lower plate of the slider 20. An outer wall concave portion 92 is further formed in at least part of the surface opposite to the side of the leg portion outer wall surface 94 in which the projecting portions 90*a*, 90*b*, 90*c* are formed.

Provision of the outer wall concave portion 92 in the leg portion outer wall surface 94 facilitates positioning of the engaging elements 12 when the leg portion outer wall surface 94 is pressed in a press-fitting process for attaching the engaging elements 12 to the side edge portion of the fastener tape 16. Consequently, the engaging elements 12 can be implanted into the side edge portion of the fastener tape 16 more accurately. Further, formation of the outer wall concave portion 92 in at least part of the leg portion outer wall surface 94 provides the appearance of the slide fastener 10 with beauty from viewpoints of design and also reduces sliding resistance generated between the inner surfaces of the upper plate and the lower plate of the slider 20 and the leg portion outer wall surface 94, so that the slide fastener 10 can be opened/closed smoothly.

According to the embodiments shown in FIGS. 2 and 3, the projecting portions 90*a*, 90*b*, 90*c* provided on the leg portion inner wall surface 88 are formed in a rib shape extending parallel to the side edge of the fastener tape 16. However, the present invention does not confine the projecting portions 90*a*, 90*b*, 90*c* to the rib shape but the projecting portions may be formed into a conical or pyramid shape, a cylindrical or rectangular cylinder shape, or another uneven shape. Further, the rib-shaped projecting portions 90*a*, 90*b*, 90*c* may be formed into a shape extending in the width direction of the fastener tape 16.

According to the embodiments shown in FIGS. 2 and 3, the projecting portions 90*a*, 90*b*, 90*c* provided on the leg portion inner wall surface 88 are formed on the opposing portions of the pair of leg portion side walls 84. However, the present invention does not confine the projecting portions 90*a*, 90*b*, 90*c* to the embodiments in which they are formed on the opposing portions of the leg portion sidewall 84. The opposing projecting portions 90*a*, 90*b*, 90*c* may be disposed in a staggered pattern or the projecting portions 90*a*, 90*b*, 90*c* may be provided on only the leg portion inner wall surface 88 on one leg portion 80.

Next, the attachment state of the engaging elements 12 to the fastener tape 16 will be described with reference to FIGS. 4 and 5. According to the embodiment shown in these figures, two rows of the core threads 14, 15 which engage the circular shaped notch portions 85, 86 formed in the engaging element 12 are provided on the side edge portion of the fastener tape 16. By pressing the pair of notch portions 85, 86 against the core threads 14, 15, the engaging elements 12 are positioned to the fastener tape 16.

As shown in FIGS. 4 and 5, a valley portion 24 is formed on the border between the core thread 14 and the core thread 15 of the fastener tape 16, and a flexion portion 25 is formed on the border between the core thread 15 and the fastener tape 16. The inner pawl 95 and the outer pawl 96, formed at ends of the notch portions 85, 86 of the engaging element 12, engage the valley portion 24 and the flexion portion 25.

The conventional engaging elements are attached to the side edge portion of the fastener tape 16 such that the core threads 14, 15 are sandwiched by the pair of notch portions 85, 86 and the inner pawl 95 and the outer pawl 96. For this reason, when a lateral pulling force or an upward pushing force is applied to the slide fastener, a force of the inner pawl 95 and the outer pawl 96 of the engaging element attempting to ride over the core threads 14, 15 is applied so that a large moment of opening the leg portions of the engaging element is applied. Thus, to maintain a required strength resisting the lateral pulling force or the upward pushing force, it is necessary to use a material having a high yield point as the material of the engaging element or to make the body portion of the engaging element thick. These are factors which make pressing to mold the engaging element difficult to do, thereby increasing the product price of the slide fastener to block prevailing of this kind of the fastener.

In the fastener stringer 18 of the present invention, the sheet-like nipping portions 82, 82 of the leg portion 80 of the engaging element 12 sandwich the core threads 14, 15, so that the core threads 14, 15 are formed massively in the diameter direction between the engaging elements 12 adjoining in the longitudinal direction of the fastener tape 16. According to the present invention, the projecting portions 90*a*, 90*b*, 90*c* formed on the leg portion inner wall surface 88 of the leg portion side wall 84 of the engaging element 12 bite into the core threads 14, 15 formed massively for engagement. This enables increase of strength resisting the lateral pulling force and upward pushing force applied to the slide fastener 10.

Further, by providing at least one projecting portion 90*a*, 90*b* on the leg portion inner wall surface 88 nearer the body portion 78 than the inner pawl 95 so as to intensify a force of fixing the core threads 14 and reducing the moment of opening the leg portions 80, the strength resisting the lateral pulling force and the upward pushing force can be increased. By providing at least one projecting portion 90*c* nearer the body portion 78 than the outer pawl 96, the moment of opening the leg portions 80 is reduced while intensifying the force of fixing the core threads 15 so as to increase the strength resisting the lateral pulling force and the upward pushing force.

As a result, it is possible to prevent faults that the engaging element 12 deviates from the fastener tape 16, the engaging element 12 is inclined or the engaging element 12 slips out of the fastener tape 16. Consequently, a material having a low yield point can be used as the material of the engaging element 12, and the body portion 78 of the engaging element 12 can be made thin, thereby intensifying the freedom of design aspect and providing an inexpensive slide fastener. Although the appearance of brass presents its brass color, it may be changed to silver or other color or into other appearance by surface treatment with plating.

FIGS. 4 and 5 show a structure which intensifies the lateral pulling force required for the slide fastener 10 by providing the side edge portion of the fastener tape 16 with two rows of the core threads 14, 15. However, the present invention does not confine the structure to the one having the two rows of the core threads 14, 15 but it may be applied to a slide fastener having one row or three rows or more.

Figure 6:
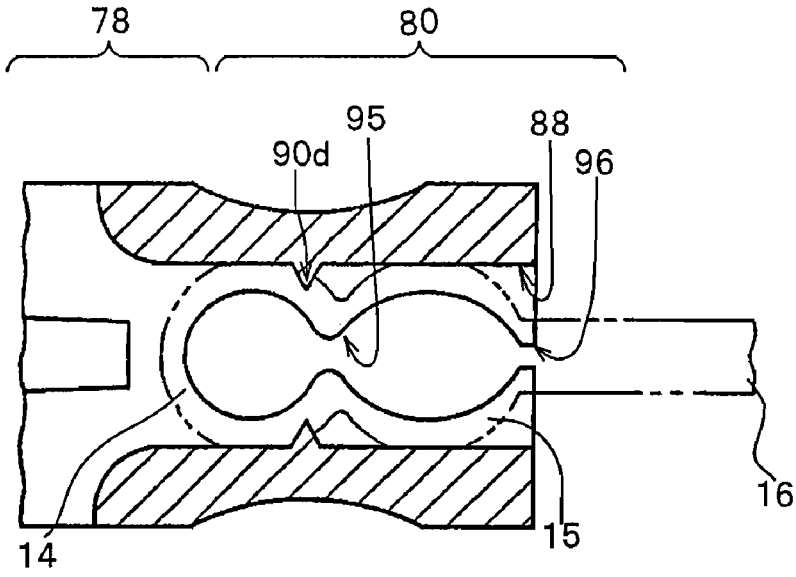
FIG. 6 is a partially sectional view showing an attachment state of an engaging element to a fastener tape according to another embodiment of the present invention.

Next, other embodiments of the projecting portion of the slide fastener engaging element of the present invention will be described with reference to FIGS. 6 and 7. FIG. 6 is a view showing an embodiment in which one projecting portion 90*d* is formed on each of opposing portions of the leg portion inner wall surface 88 nearer the body portion 78 than the inner pawl 95. By forming the projecting portion 90*d* nearer the body portion 78 than the inner pawl 95 as shown in FIG. 6, the force of fixing the core thread 14 is increased so as to intensify the strength resisting the lateral pulling force and the upward pushing force of the slide fastener.

Figure 7:
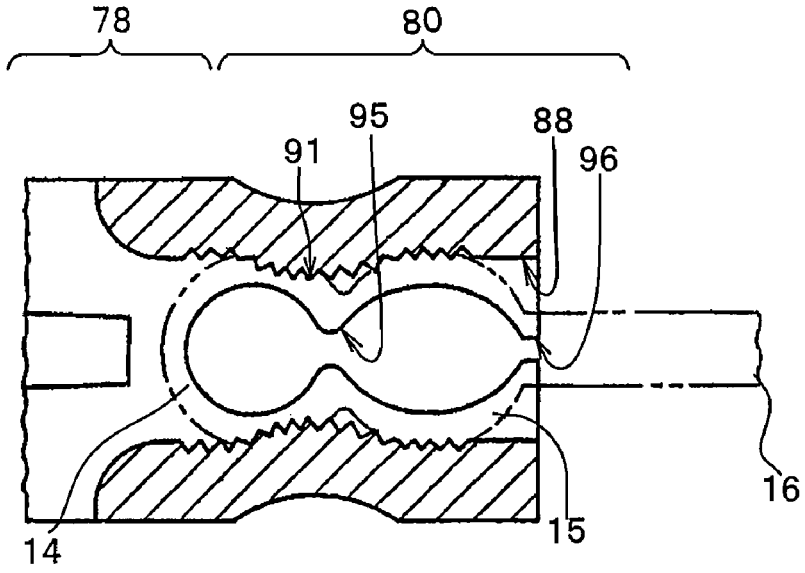
FIG. 7 is a partially sectional view showing an attachment state of an engaging element to a fastener tape according to still another embodiment of the present invention.

FIG. 7 shows an embodiment in which fine saw-tooth like projecting portions 91 are formed on opposing portions of the leg portion inner wall surface 88 nearer the body portion 78 than the outer pawl 96. By forming the projecting portions 91 nearer the body portion 78 than the outer pawl 96, the force of fixing the core thread 14 and the core thread 15 is intensified so as to increase the lateral pulling force and upward pushing force of the slide fastener. As the plan view shape of the projecting portion 91, it is permissible to use stripe-like, twilled pattern or pointed-like projecting portions.

By providing at least one projecting portion on the leg portion inner wall surface of the slide fastener engaging element so as to sandwich the side edge portion of the fastener tape therewith, an inexpensive material can be used as the material of the engaging element, and the freedom of the design of the engaging element can be intensified. Consequently, the vintage fastener which has been expensive conventionally can be provided at low cost.

What is claimed is:

1. A slide fastener engaging element made of metal in which a head portion, a body portion and a pair of leg portions are integrally formed, the leg portions being branched from the body portion to right and left so as to be attached to one side edge portion of a fastener tape so that the one side edge portion is sandwiched thereby, wherein each of the pair of leg portions is formed into an L-like section shape having a sheet-like nipping portion and a leg portion side wall that rises at a right angle from a right or left outside side edge of the sheet-like nipping portion, the sheet-like nipping portion has notch portions for sandwiching the one side edge portion of the fastener tape from front and rear surfaces, and at least one projecting portion is provided on a leg portion inner wall surface of the leg portion side wall opposing the one side edge portion of the fastener tape.

2. The slide fastener engaging element according to claim 1, wherein a leg portion outer wall surface of the leg portion side wall has a sliding surface which makes contact with an inside surface of a slider for a slide fastener.

3. The slide fastener engaging element according to claim 1, wherein the projecting portion is formed in a rib shape extending parallel to a longitudinal direction of the fastener tape.

4. The slide fastener engaging element according to claim 1, wherein the projecting portion is formed on each of opposing portions of the pair of leg portion side walls.

5. The slide fastener engaging element according to claim 1, wherein an outer wall concave portion is formed in the leg portion outer wall surface of the leg portion side wall opposite to the surface from which the projecting portion is projected.

6. A slide fastener adopting the slide fastener engaging element according to claim 1.

* * * * *

UNITED STATES PATENT AND TRADEMARK OFFICE

CERTIFICATE OF CORRECTION

PATENT NO. : 8,015,674 B2
APPLICATION NO. : 12/037169
DATED : September 13, 2011
INVENTOR(S) : Shoji Matsui et al.

It is certified that error appears in the above-identified patent and that said Letters Patent is hereby corrected as shown below:

In column 6, line 42, delete “sidewall” and insert -- side wall --, therefor.

Signed and Sealed this
Eighth Day of November, 2011

David J. Kappos

David J. Kappos
*Director of the United States Patent and Trademark Office*